US006296442B1

(12) United States Patent
Tran

(10) Patent No.: US 6,296,442 B1
(45) Date of Patent: Oct. 2, 2001

(54) TURBOMACHINE STATOR VANE SET

(75) Inventor: Hung Quac Tran, Milmort (BE)

(73) Assignee: Techspace Aero, Herstal (BE)

( * ) Notice: Subject to any disclaimer, the term of this patent is extended or adjusted under 35 U.S.C. 154(b) by 0 days.

(21) Appl. No.: 09/446,131

(22) PCT Filed: Apr. 27, 1999

(86) PCT No.: PCT/EP99/03390

§ 371 Date: Dec. 29, 1999

§ 102(e) Date: Dec. 29, 1999

(30) Foreign Application Priority Data

May 1, 1998 (EP) ..... 98201416

(51) Int. Cl.[7] ..... F01D 9/04

(52) U.S. Cl. ..... 415/189; 415/209.2; 415/209.4; 415/210.1; 29/889.22

(58) Field of Search ..... 415/189, 190, 415/209.2, 209.3, 209.4, 210.1; 29/889.22, 889.21

(56) References Cited

U.S. PATENT DOCUMENTS 2,661,147 * 12/1953 Anderson ..... 415/209.3
4,710,097 * 12/1987 Tinti .
4,722,184 * 2/1988 Chaplin et al. .
4,832,568 * 5/1989 Roth et al. ..... 415/189
5,743,711 * 4/1998 Fournier et al. ..... 415/189

FOREIGN PATENT DOCUMENTS

967089 * 10/1957 (DE) .
1476928 * 7/1969 (DE) .
243274 * 10/1987 (EP) .
616110 * 9/1994 (EP) .
2106561 * 5/1972 (FR) .
2321616 * 3/1977 (FR) .
2110768 * 6/1983 (GB) ..... 415/209.2

* cited by examiner

*Primary Examiner*—Christopher Verdier
(74) *Attorney, Agent, or Firm*—Oblon, Spivak, McClelland, Maier & Neustadt, P.C.

(57) ABSTRACT

A turbomachine stator vane set includes a ring of vanes having platforms arranged in a housing formed on an outer shell. The bottom of the housing has a non-planar surface which is spherical or cylindrical with a radius of curvature R, and the cooperating surface of the platforms has a corresponding non-planar surface which is spherical or cylindrical with a larger radius of curvature R+ΔR prior to fitting and which is reduced to the radius R under stress, by the action of fastening rivets used to assemble the vane platforms with the outer shell.

8 Claims, 3 Drawing Sheets

TURBOMACHINE STATOR VANE SET

BACKGROUND OF THE INVENTION

The present invention relates to a turbomachine stator vane set comprising arrangements for fastening the vanes of which it is formed.

The invention is particularly applicable to a stator vane set of a multi-stage turbojet engine.

DISCUSSION OF THE BACKGROUND

Various solutions have been used to fasten the vanes of a turbojet engine stator. Commonly, the vanes are arranged between a radially outer stator shell and a radially inner stator shell which delimit the profile of the duct for the stream flowing through the passage.

FR-A-2 321 616 thus discloses a fastening of the vane end platforms by bolting to the outer shell.

FR-A-2 671 133 also discloses a stator vane set where the vanes are fastened using a sleeve resting against the external surface of the outer shell and crimped onto a rod borne by the end of the vane.

SUMMARY OF THE INVENTION

The objective of the invention is to provide an alternative solution which makes it easier to fasten the vanes of a stator vane set. One of the objects of the invention is also to immobilize the vanes of the stator vane set to prevent them from rotating during mounting and in operation.

The objective is achieved according to the invention by the fact that the outer shell has a housing, the bottom of which has a non-planar surface, which is spherical or cylindrical with a radius of curvature R, into which are inserted the platforms of the vanes, the cooperating surface of which has a corresponding non-planar shape which is spherical or cylindrical with a larger radius of curvature R+delta R prior to fitting and which is reduced to the radius R under stress, by the action of fastening rivets used to assemble the vane platforms with the outer shell.

BRIEF DESCRIPTION OF THE DRAWINGS

Other features and advantages of the invention will be better understood upon reading the description which will follow of one embodiment of the invention, with reference to the appended drawings, in which.

DESCRIPTION OF THE PREFERRED EMBODIMENTS

Figure 1:
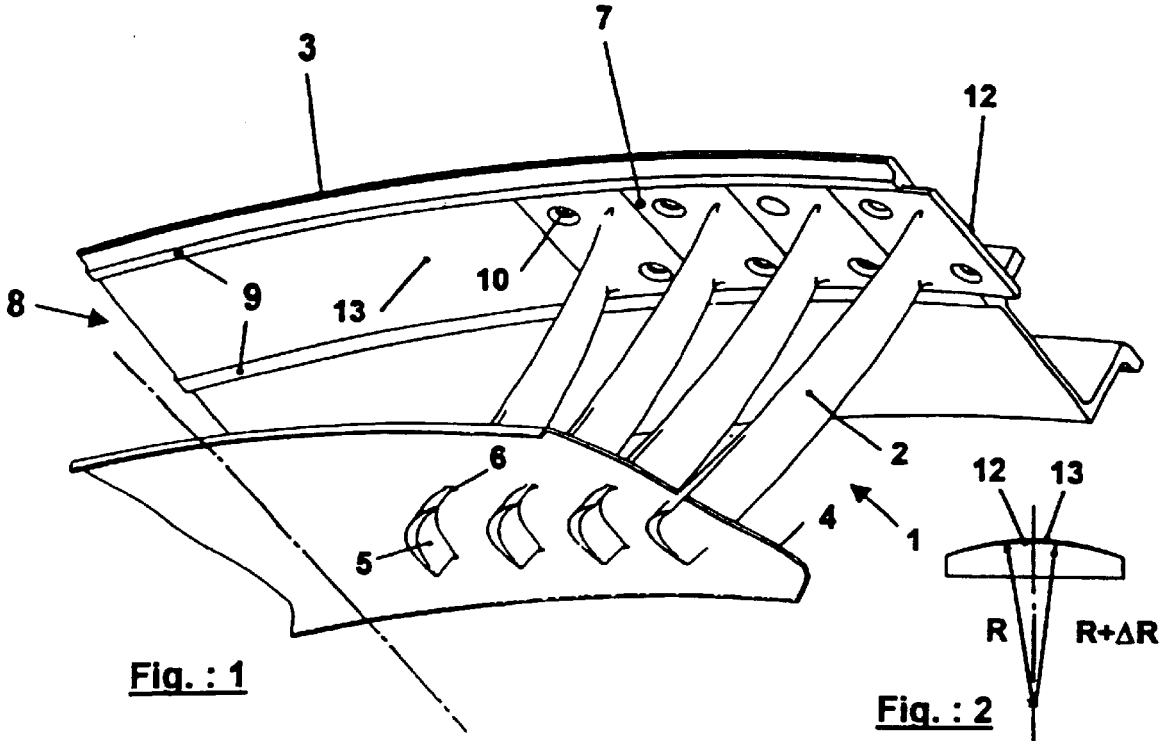
FIG. 1 depicts a diagrammatic part view in perspective of a turbomachine stator vane set according to the invention, during assembly.

FIGS. 1–7 show one embodiment of a stator vane set 1 according to the invention and constituting a fixed stage of a multi-stage turbojet engine. In the conventional way, the stator vane set 1 consists of a ring of vanes 2 located between a radially outer stator shell 3 and a radially inner stator shell 4. The radially inner end 5 of each vane 2 is inserted into a slot 6 of complementary shape formed in said inner shell 4. At its radially outer end, the aerofoil part of the vane 2 has a platform 7 which is placed in a housing 8 formed between two shoulders 9 on the interior face of the outer shell 3. Each platform 7 has drillings 10, numbering two per platform according to the preferred embodiment depicted in the drawings, and arranged one on each side of the aerofoil part of the vane, in opposed positions along a diagonal of the platform 7. The outer shell 3 has corresponding drillings.

Figure 2:
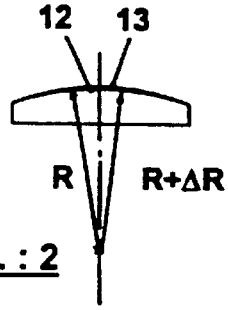
FIG. 2 depicts a diagrammatic sectioned view of the surfaces for assembly between vane platform and housing.
Figure 4:
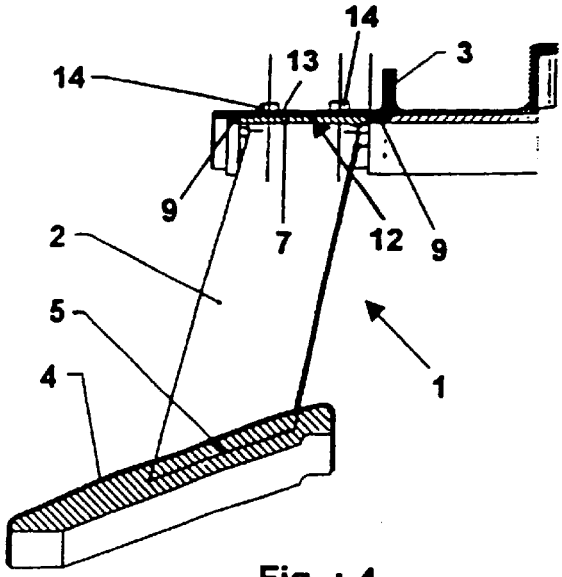
FIG. 4 depicts a view in section on a longitudinal plane of a mounted vane of the stator vane set depicted in FIG. 3.
Figure 3:
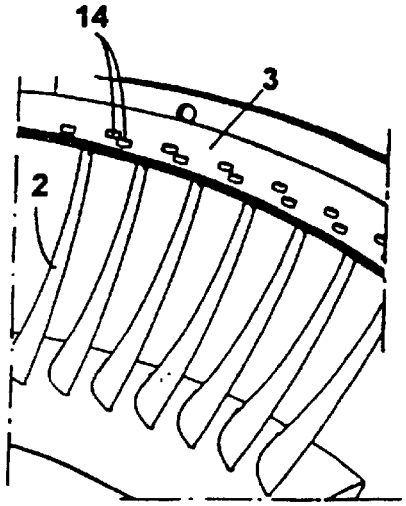
FIG. 3 depicts a diagrammatic part view in perspective of the stator vane set depicted in FIG. 1, in the assembled state.

Noteworthily and according to the invention, the upper face 12 of the platform 7 has a non-planar shape, the radius of curvature of which prior to the mounting of the vane is R+delta R, as shown diagrammatically in FIG. 2. The shape produced may be spherical or cylindrical. The corresponding bottom 13 of the housing 8 of the outer shell 3 also has a non-planar surface, the radius of curvature R of which is smaller than the radius of curvature of the platform prior to mounting. The shape produced by machining is spherical or cylindrical corresponding to that of the platform.

After fitting, the platforms 7 of the vanes 2 are fastened to the outer shell 3 using rivets 14 introduced into the corresponding drillings. Once the rivets 14 have been fastened, the upper face 12 of the platform 7 and the bottom 13 of the housing 8 come into contact through the deformation of the platforms whose radius R+delta R is rendered equal to the radius R of the housing, thus achieving spherical or cylindrical contact, depending on the shape adopted, between the platform 7 and the housing 8.

Figure 5:
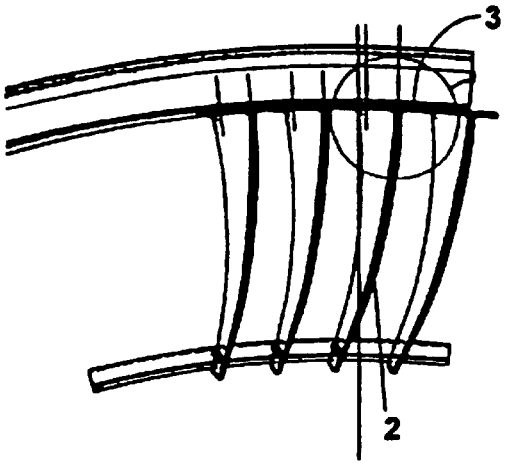
FIG. 5 depicts a part view in transverse section of the stator vane set depicted in FIG. 3.
Figure 6:
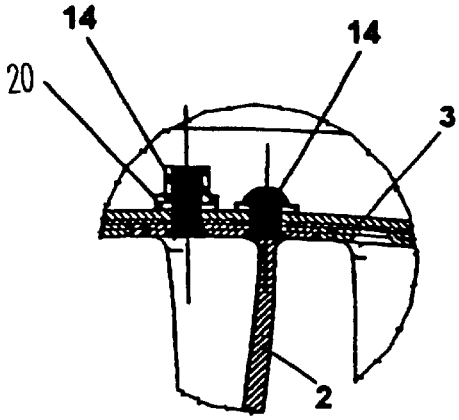
FIG. 6 depicts an enlarged detail of FIG. 5.
Figure 7:
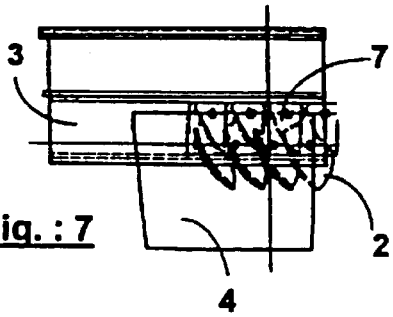
FIG. 7 depicts a part view from above of the stator vane set depicted in FIG. 3.

As depicted in FIGS. 5 and 6, washers 20 may be placed under the heads of the rivets 14 to prevent an effect of upsetting on the outer shell 3, depending on the materials employed.

The shoulders 9 formed on each side of the housing 8 on the outer shell 3 provide guidance for mounting the platforms 7 in the housing 8 and also immobilize the vanes to prevent them from rotating during mounting and in operation.

Figure 8:
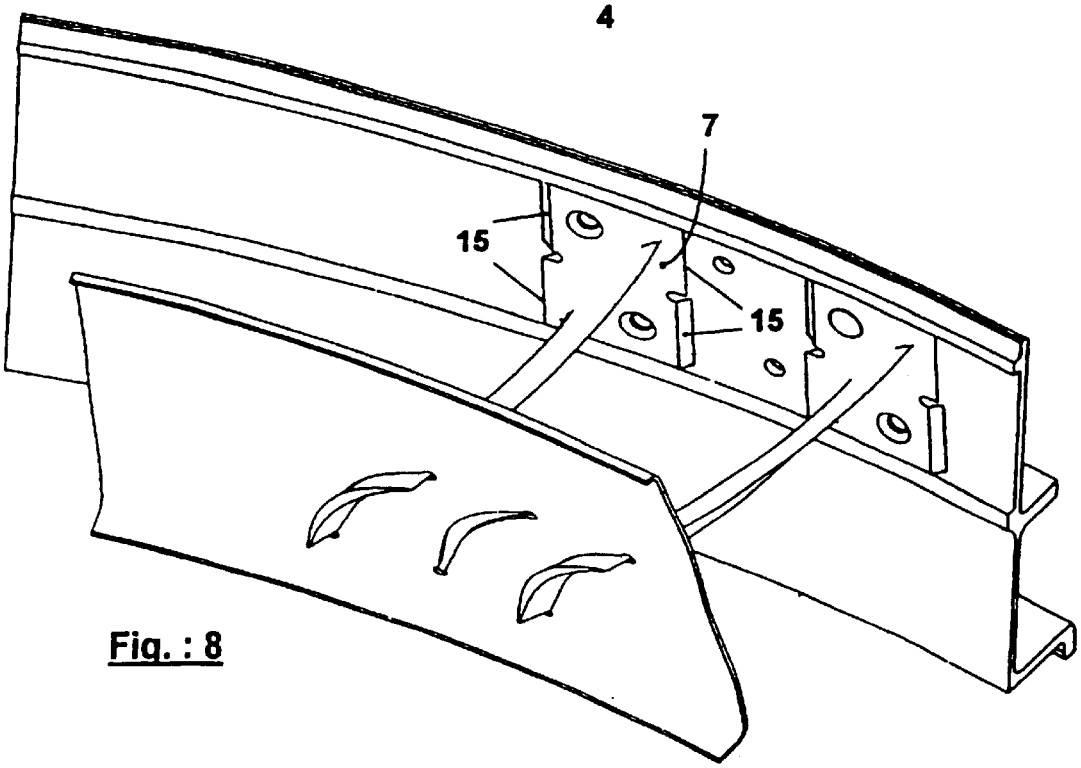
FIG. 8 depicts, in a view similar to that of FIG. 1, a stator vane set according to the invention comprising one example of an arrangement for immobilizing the vanes to prevent them from dropping out.

To prevent the stator vane 2 from dropping out during mounting, or if one of the rivets 14 should be lost, complementary arrangements may be made in the stator vane set 1 according to the invention. The adjacent edges 15 of the platforms 7 are chamfered in one direction along half of their length and in the other direction along the other half of their length, as depicted in FIG. 8.

Figure 9:
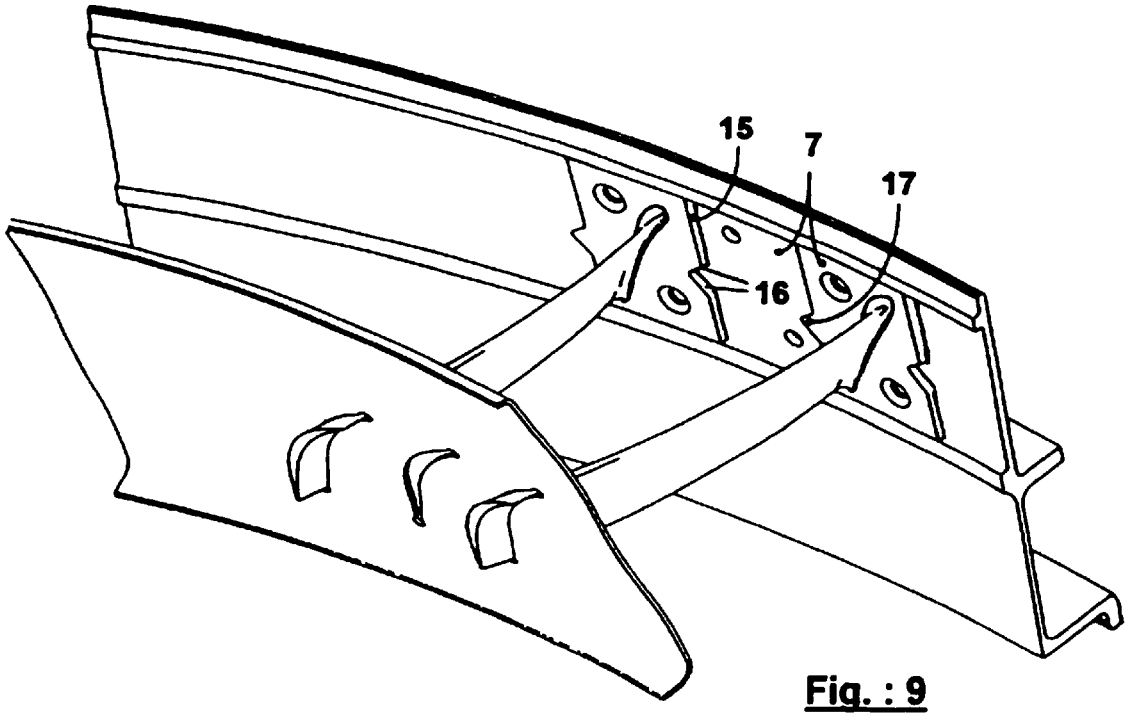
FIG. 9 depicts, in a view similar to that of FIG. 8, another example of the immobilization of the vanes of a stator according to the invention to prevent them from dropping out.

As an alternative, as depicted in FIG. 9, a recessed triangular notch 16 may be formed on one edge 15 of the platform, while the adjacent edge of the platform next to it bears the corresponding protruding element 17.

Figure 10:
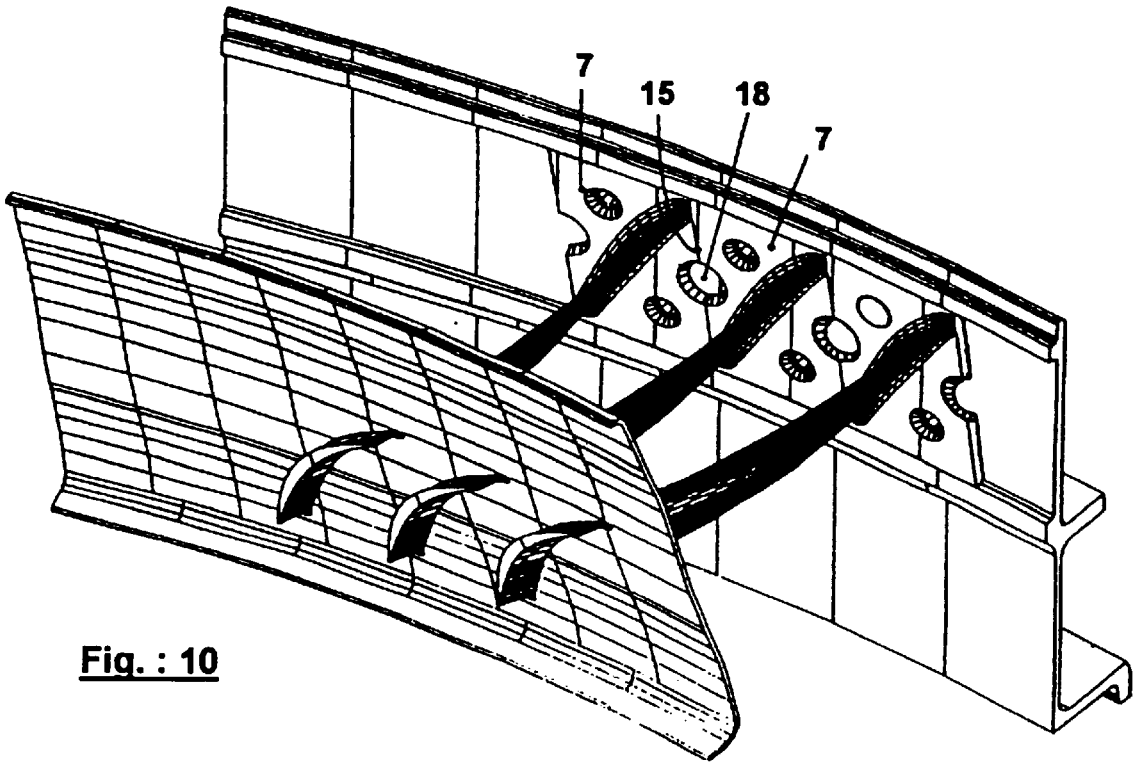
FIG. 10 depicts, in a view similar to that of FIG. 9, another example of the immobilization of the vanes of a stator according to the invention to prevent them from dropping out.

As an alternative, an additional rivet may also be added, placed astride the two adjacent edges of platforms 7 which are next to each other, as depicted at 18 in FIG. 10.

What is claimed is:

1. Turbomachine stator vane set including a ring of vanes located between a radially outer stator shell and a radially inner stator shell, the inner end of each vane being placed in a slot of complementary shape formed in said inner shell, and the outer end of each vane bearing a platform which is fixed to the interior face of the outer shell, characterized in that the outer shell has a housing, the bottom of which has a non-planar surface, which is spherical or cylindrical with a radius of curvature R, into which are inserted the platforms of the vanes, the cooperating surface of each vane has a corresponding non-planar surface which is spherical or cylindrical with a larger radius of curvature R+delta R prior to fitting and which is reduced to the radius R under stress, by the action of fastening rivets used to assemble the vane platforms with the outer shell.

2. Turbomachine stator vane set according to claim 1, characterized in that the housing is delimited on the interior face of the outer shell by two shoulders which provide guidance for mounting the platforms and immobilize the vanes to prevent them from rotating during mounting and in operation, and the fastening rivets number two per platform, each arranged on each side of a vane in opposed positions along a diagonal of a platform.

3. Turbomachine stator vane set according to claim 1, characterized in that the edges of the platforms are chamfered in one direction along half of their length and in the other direction along the other half of their length and such that the chamfered platforms complement each other along adjacent edges (15) of two platforms (7) which are next to each other.

4. Turbomachine stator vane set according to claim 1, characterized in that a recessed triangular notch is formed on one edge of each platform, and the adjacent edge of the platform next to it bears a corresponding protruding element.

5. Turbomachine stator vane set according to claim 1, characterized in that an additional rivet is placed astride the two adjacent edges of two platforms which are next to each other.

6. Turbomachine stator vane set according to claim 2, characterized in that the edges of the platforms are chamfered in one direction along half of their length and in the other direction along the other half of their length and such that the chamfered platforms complement each other along adjacent edges of two platforms which are next to each other.

7. Turbomachine stator vane set according to claim 2, characterized in that a recessed triangular notch is formed on one edge of each platform, and the adjacent edge of the platform next to it bears a corresponding protruding element.

8. Turbomachine stator vane set according to claim 2, characterized in that an additional rivet is placed astride the two adjacent edges of two platforms which are next to each other.

* * * * *

UNITED STATES PATENT AND TRADEMARK OFFICE

CERTIFICATE OF CORRECTION

PATENT NO. : 6,296,442 B1
DATED : October 2, 2001
INVENTOR(S) : Hung Quac Tran

It is certified that error appears in the above-identified patent and that said Letters Patent is hereby corrected as shown below:

Column 3,
Line 27, delete "(15)" and delete "(7)".

Signed and Sealed this

Sixth Day of August, 2002

*Attest:*

*Attesting Officer*

JAMES E. ROGAN
*Director of the United States Patent and Trademark Office*